US007836699B2

(12) United States Patent
Graves

(10) Patent No.: US 7,836,699 B2
(45) Date of Patent: Nov. 23, 2010

(54) COMBUSTOR NOZZLE

(75) Inventor: Charles B. Graves, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 1252 days.

(21) Appl. No.: 11/312,158

(22) Filed: Dec. 20, 2005

(65) Prior Publication Data

US 2007/0137212 A1 Jun. 21, 2007

(51) Int. Cl.
*F02G 3/00* (2006.01)

(52) U.S. Cl. ..... 60/748; 60/737; 60/740

(58) Field of Classification Search ..... 60/737, 60/740, 746, 748
See application file for complete search history.

(56) References Cited

U.S. PATENT DOCUMENTS 3,570,242 A * 3/1971 Leonardi ..... 60/737
3,763,650 A * 10/1973 Hussey et al. ..... 60/39.463
4,696,157 A * 9/1987 Barbier et al. ..... 60/39.23
5,029,557 A * 7/1991 Korenberg ..... 122/149
5,123,241 A * 6/1992 Lotan ..... 60/806
5,267,442 A 12/1993 Clark
5,269,679 A * 12/1993 Syska et al. ..... 431/9
5,288,021 A * 2/1994 Sood et al. ..... 239/132.5
5,351,475 A * 10/1994 Ansart et al. ..... 60/804
5,361,578 A * 11/1994 Donlan ..... 60/800
5,372,008 A * 12/1994 Sood ..... 60/737
5,373,694 A 12/1994 Clark
5,540,056 A * 7/1996 Heberling et al. ..... 60/737
5,901,549 A 5/1999 Mandai et al.
5,966,937 A 10/1999 Graves
6,070,412 A * 6/2000 Ansart et al. ..... 60/747
6,119,459 A * 9/2000 Gomez et al. ..... 60/748
6,672,859 B1 * 1/2004 Rabovitser et al. ..... 431/9
6,675,587 B2 1/2004 Graves et al.
6,857,274 B2 * 2/2005 Sprouse et al. ..... 60/776
7,251,940 B2 * 8/2007 Graves et al. ..... 60/742
7,536,862 B2 * 5/2009 Held et al. ..... 60/742

FOREIGN PATENT DOCUMENTS

EP 1156281 A2 11/2001
EP 1445538 A1 8/2004

OTHER PUBLICATIONS

European Search Report for EP Patent Application No. 06256345.7, dated Jun. 4, 2010.

* cited by examiner

*Primary Examiner*—Michael Cuff
*Assistant Examiner*—Phutthiwat Wongwian
(74) *Attorney, Agent, or Firm*—Bachman & LaPointe, P.C.

(57) ABSTRACT

A gas turbine engine swirler/nozzle apparatus has a swirler having a central axis and a nozzle. The nozzle has an outlet end with a plurality of outlets about the central axis and having an asymmetry about the central axis. The apparatus may be formed as a reengineering of a baseline apparatus having a symmetric nozzle.

9 Claims, 6 Drawing Sheets

COMBUSTOR NOZZLE

U.S. GOVERNMENT RIGHTS

The invention was made with U.S. Government support under contract N00019-02-C3003 awarded by the U.S. Navy. The U.S. Government has certain rights in the invention.

BACKGROUND OF THE INVENTION

This invention relates to combustors, and more particularly to combustors for gas turbine engines.

Gas turbine engine combustors may take several forms. An exemplary class of combustors features an annular combustion chamber having forward/upstream inlets for fuel and air and aft/downstream outlet for directing combustion products to the turbine section of the engine. An exemplary combustor features inboard and outboard walls extending aft from a forward bulkhead in which swirlers are mounted and through which fuel nozzles/injectors are accommodated for the introduction of inlet air and fuel. Exemplary walls are double structured, having an interior heat shield and an exterior shell. An example of a combustor layout is disclosed in U.S. Pat. No. 6,675,587. An example of a swirler is disclosed in U.S. Pat. No. 5,966,937. The disclosures of these patents are incorporated by reference herein as if set forth at length.

SUMMARY OF THE INVENTION

A gas turbine engine swirler/nozzle apparatus has a swirler having a central axis and a nozzle. The nozzle has an outlet end with a plurality of outlets about said axis and having an asymmetry about said axis.

The apparatus may be formed as a reengineering of a baseline apparatus having a symmetric nozzle and may be used in a reengineering or remanufacturing of a gas turbine engine.

The asymmetry may be effective to provide a lesser fuel flow from a first half of the nozzle than from a complementary second half, the first half relatively inboard of the second half. The reengineering/remanufacturing may be performed so as to provide a final revised swirler/nozzle having a more even associated temperature distribution at the combustor exit than a temperature distribution associated with a baseline swirler/nozzle.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figures 1, 2:
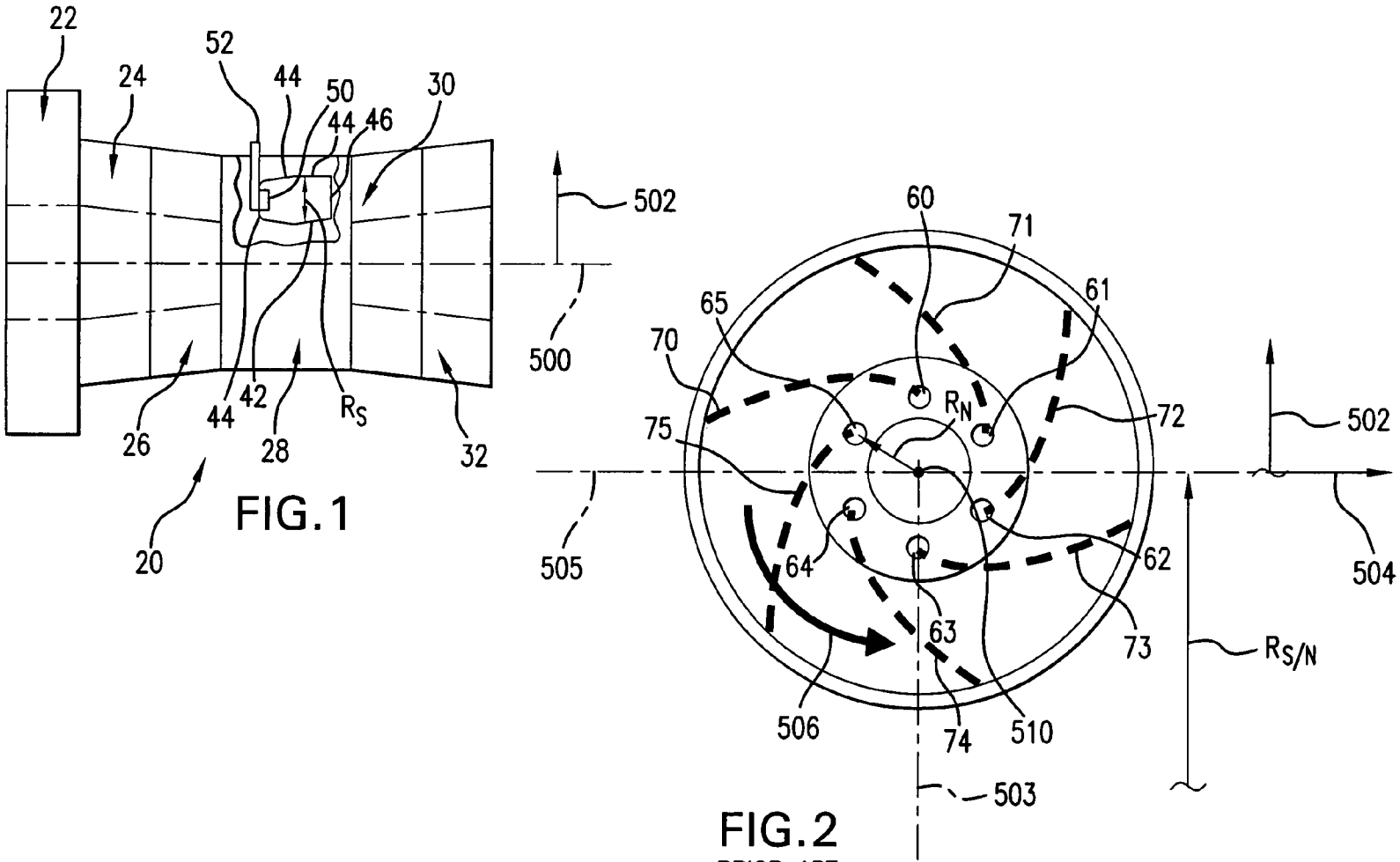
FIG. 2 PRIOR ART
FIG. 1 is a schematic longitudinal view of an exemplary engine.
FIG. 2 is a downstream end view of a prior art swirler/nozzle.

FIG. 1 shows, schematically, a gas turbine engine 20 having, from upstream to downstream, a fan 22, a low pressure compressor 24, a high pressure compressor 26, a combustor 28, a high pressure turbine 30, and a low pressure turbine 32. The engine has a centerline or central longitudinal axis 500.

The combustor 28 is an annular combustor encircling the centerline 500 (e.g., as opposed to an array of can-type combustors). The combustor has a wall structure formed by a forward bulkhead 40 joining upstream/forward ends of inboard and outboard walls 42 and 44. The combustor has an open outlet/exit end 46. A circumferential array of swirler/nozzle assemblies 50 is mounted in the bulkhead. The assemblies 50 may include nozzle legs 52 extending to the engine case. The combustor has a radial span $R_S$ between the inboard and outboard wall which may vary from upstream-to-downstream.

FIG. 2 is a downstream end view of an exemplary swirler/nozzle. An engine radially outward direction 502 (and associated local radial plane 503) and an engine circumferential direction 504 (and associated local circumferential plane 505) are also shown. A direction of air swirl 506 is also shown. The swirler/nozzle 40 has a central longitudinal axis 510 locally at a radius $R_{S/N}$ from the engine centerline 500. This axis 510 may typically be close to parallel to the engine centerline 500 (e.g., lying in a common radial plane with the centerline 500 at an angle within 15° of parallel thereto). Typically, the axis 510 may be oriented to approximately intersect radial means of the high pressure compressor outlet and high pressure turbine inlet.

Figure 3:
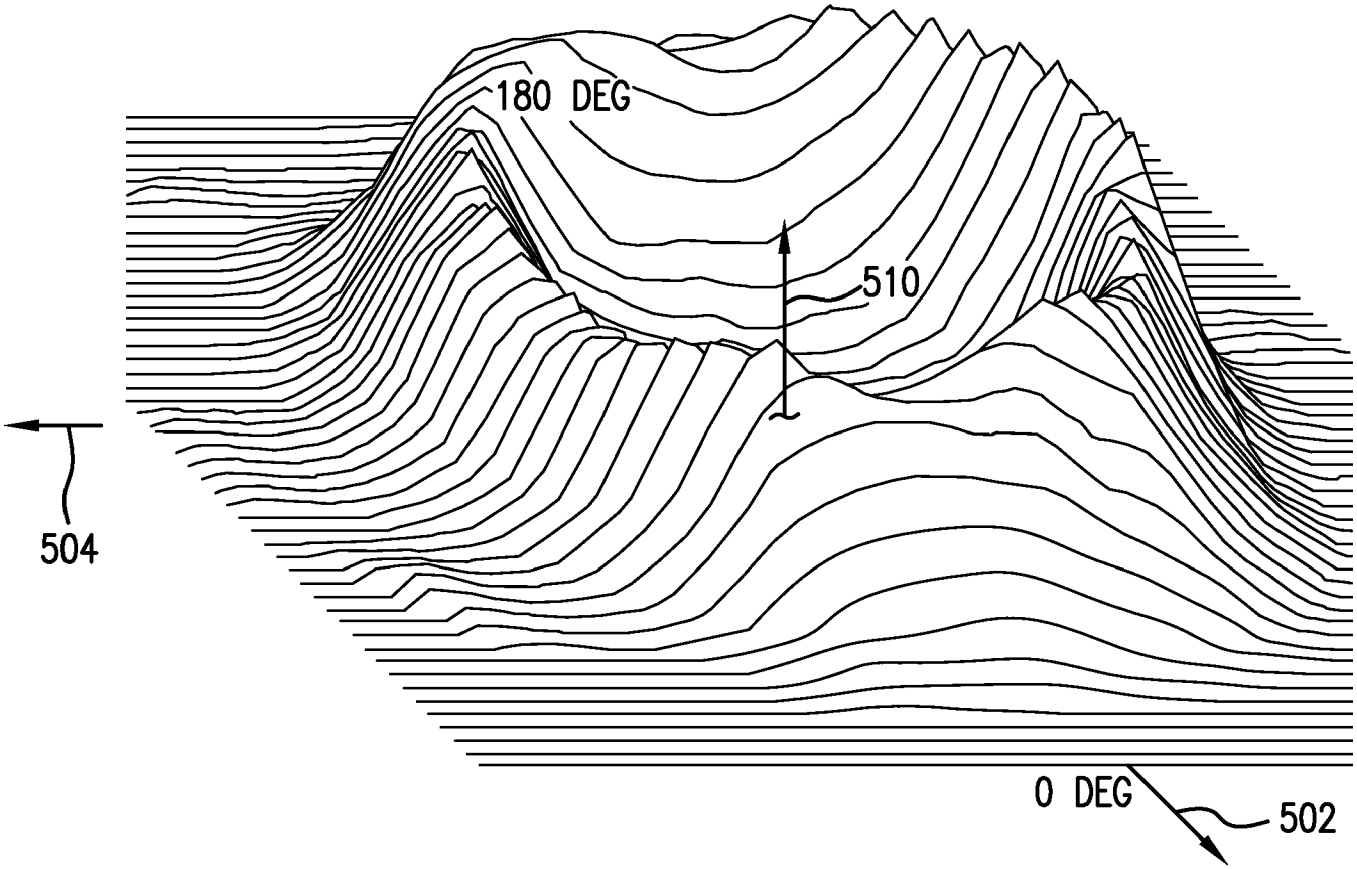
FIG. 3 PRIOR ART
FIG. 3 is a view of a spray distribution of the nozzle of FIG. 2.

The exemplary swirler/nozzle of FIG. 2 includes a plurality of individual fuel orifices or outlets 60, 61, 62, 63, 64, and 65. Viewed from aft/downstream, these are evenly circumferentially spaced about the axis 510 at a given radius $R_N$. Each of the outlets 60-65 discharges an associated spray 70, 71, 72, 73, 74, and 75, respectively. The sprays 70-75 flow downstream where they are influenced by the swirler airflow having a swirl component in the direction 506. Although initially symmetric, aerodynamic and inertial forces may produce an asymmetric spray distribution. FIG. 3 shows an exemplary fuel patternation. Various aspects of this distribution may give rise to irregular and non-optimal combustion parameters including uneven combustion with potentially non-optimal smoke and emissions. This may increase difficulties of achieving desired emissions control. It may also cause localized heating and, thereby, increase hardware robustness requirements.

Figure 4:
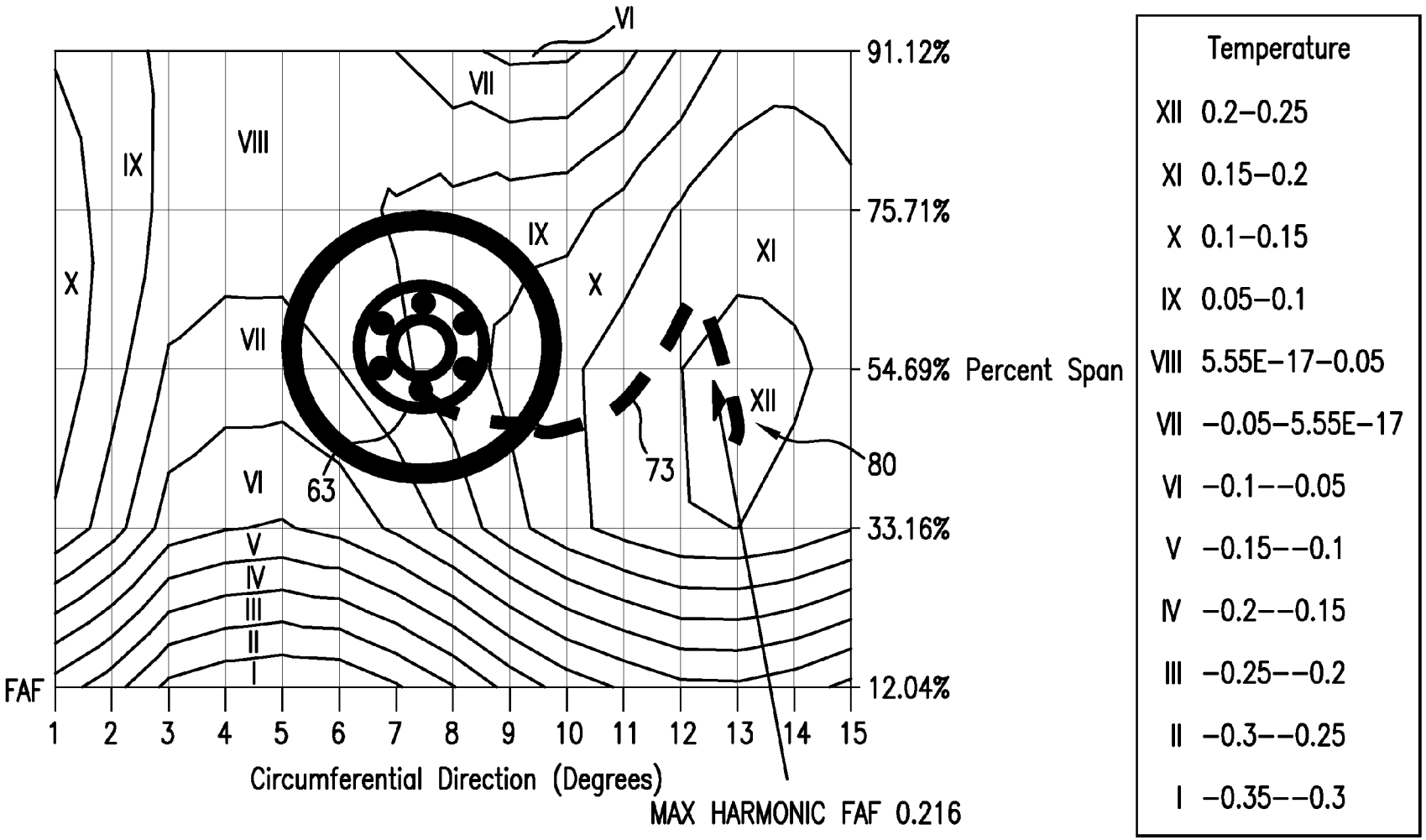
FIG.4 PRIOR ART
FIG. 4 is a view of a combustor exit fuel-air distribution associated with the nozzle of FIG. 2.

FIG. 4 shows a normalized combustor exit fuel-air distribution for the nozzle of FIG. 2 over an annular segment associated with that nozzle. This translates into a similar temperature distribution. There is a 1-4-1 correspondence between the fuel-air ratio and temperature for lean mixtures. The nozzle is shown superposed centered approximately 7.5° along the circumferential direction and 55% of the radial span. A hot spot 80 (e.g., relatively rich but still typically below stoichiometric) appears in the associated distribution. The hot spot is notionally depicted in a region most closely associated with the spray 73 of the inboardmost outlet 63. This gives rise to the possibility that a redistribution of the fuel flow may reduce the relative significance of the hot spot. Exemplary redistributions may involve adding an asymmetry, irregularity, and/or other unevenness.

Figure 5:
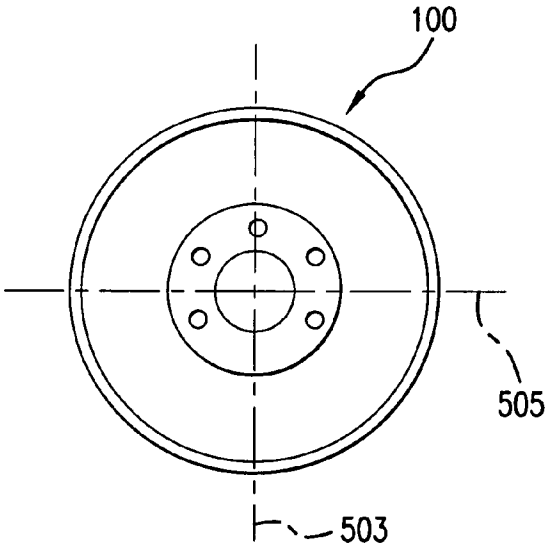
FIG. 5 is a downstream end view of a first reengineered swirler/nozzle.

In one example, with all other factors held the same, a reduction in the flow from the inboardmost outlet 63 might provide such a reduction. FIG. 5 shows such a modified swirler/nozzle wherein the inboardmost outlet 63 has been removed to eliminate the spray 73. An exemplary modification may be made in a reengineering of a baseline (e.g., prior art swirler/nozzle or combustor). This may be a part of a reengineering of a baseline engine configuration or a remanufacturing of the baseline engine. The reengineering may be performed wholly or partially as a computer simulation or physical experiment and may be an iterative process. One characteristic of the exemplary added asymmetry is that the centroid of the mass flow of fuel (either at the nozzle or measured downstream in the absence of disturbance from the air flow) is shifted away from the nozzle centerline opposite the removed outlet.

Figure 6:
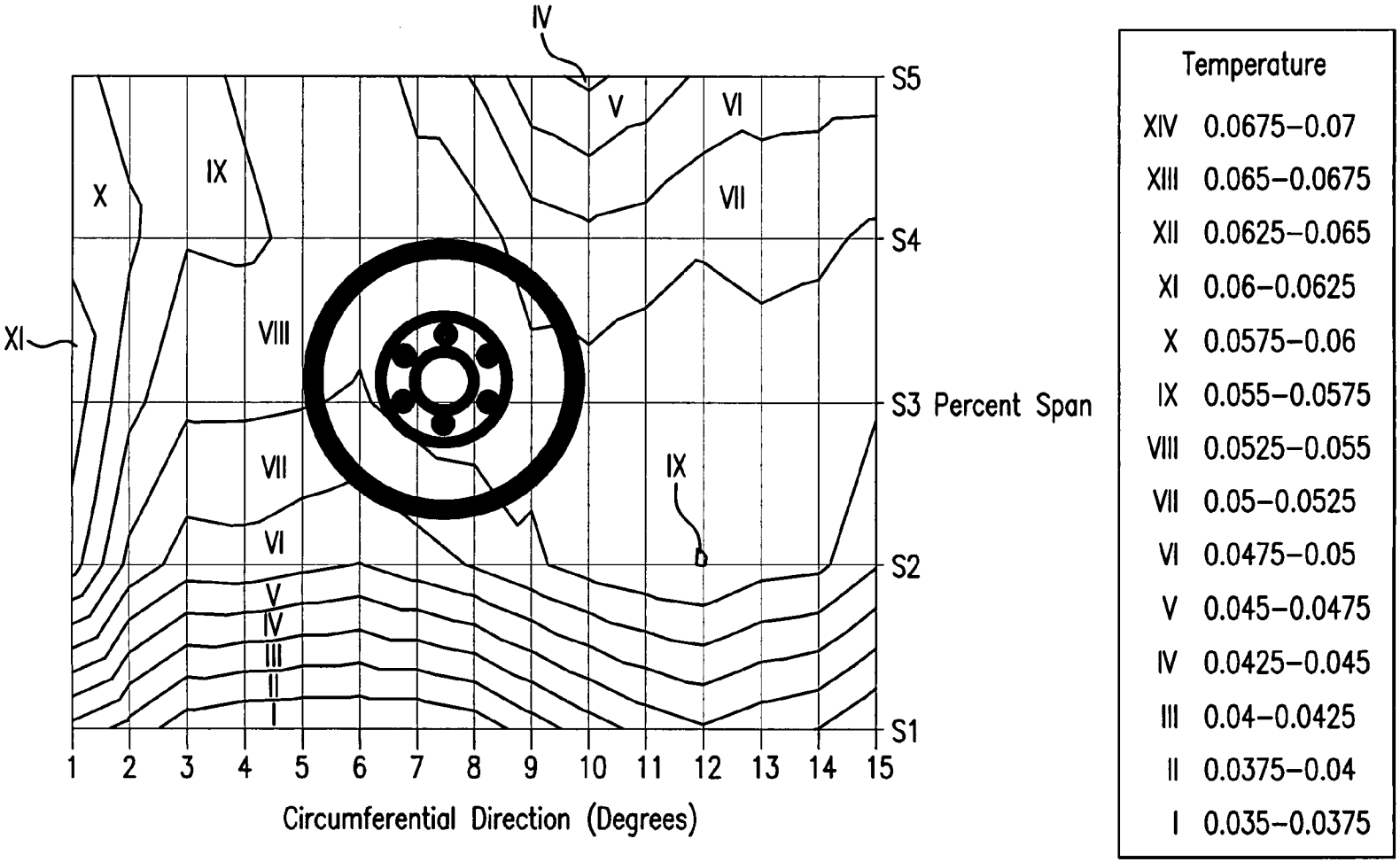
FIG. 6 is a view of a combustor exit fuel-air distribution associated with the nozzle of FIG. 5.

FIG. 6 shows a temperature distribution with the outlet 63 and spray 73 eliminated. For purposes of the experiment, the other flows were kept the same. However, in a real life reengineering, they would be increased proportionately. Nevertheless, the improved uniformity of FIG. 6 indicates that a similar uniformity would be achieved even with the increased flow rates of the remaining sprays.

Figure 7:
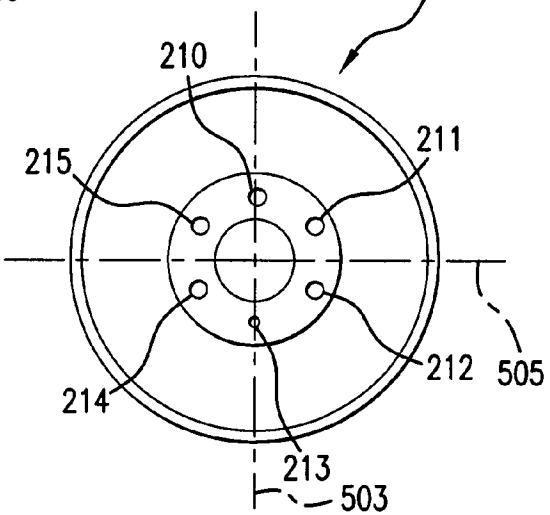
FIG. 7 is a downstream end view of a second reengineered swirler/nozzle.

Alternatively to the configuration of FIG. 5, FIG. 7 shows a swirler/nozzle 200 having individual outlets 210, 211, 212, 213, 214, and 215 at similar positions to the outlets 60-65 but with the inboardmost outlet 213 relatively downsized to provide a smaller flow than the remaining outlets. As with the FIG. 5 swirler/nozzle, the fuel flow from the nozzle half inboard of the local circumferential plane 505 is reduced below that from the outboard half.

Figure 8:
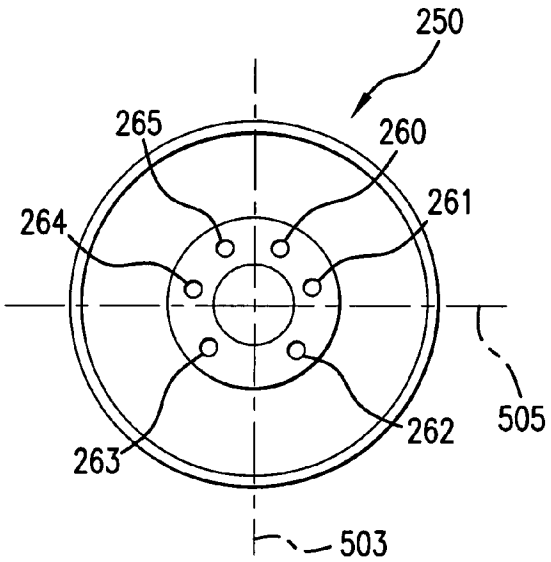
FIG. 8 is a downstream end view of a third reengineered swirler/nozzle.

FIG. 8 shows a swirler/nozzle 250 which may be formed as a third reengineering of the swirler/nozzle of FIG. 2. The swirler/nozzle 250 has individual outlets 260, 261, 262, 263, 264, and 265. In this exemplary reengineering, the nozzle positions are redistributed to reduce the amount of flow discharged from the inboard half of the swirler/nozzle.

Although these exemplary reengineerings have maintained symmetry across a local radial plane, yet further asymmetries may be introduced to tailor combustion parameters to provide a desired uniformity of temperature distribution.

Figure 9:
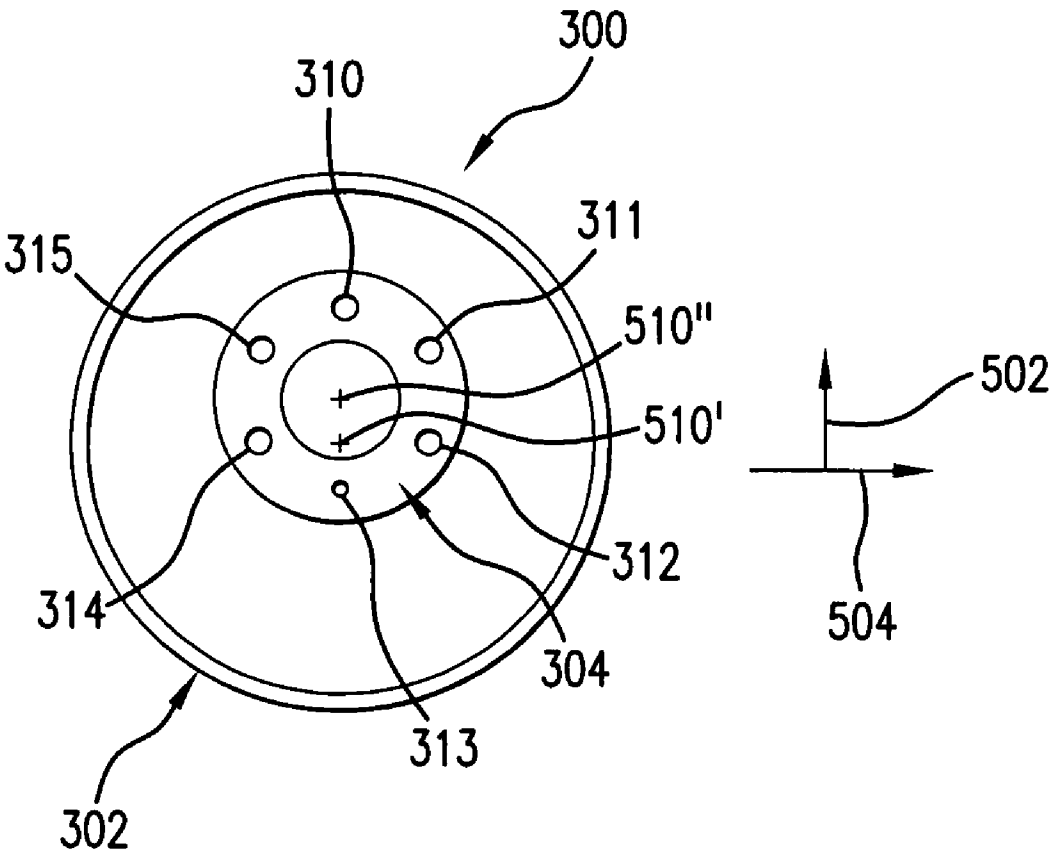
FIG. 9 is a downstream end view of a fourth reengineered swirler/nozzle.

As an alternative to or in addition to a pure nozzle asymmetry, there may be a swirler asymmetry. FIG. 9 shows a swirler/nozzle 300 which may be formed as a fourth reengineering of the swirler/nozzle of FIG. 2. The swirler/nozzle 300 has a swirler portion 302 and a nozzle portion 304. The exemplary nozzle portion 304 has outlets 310, 311, 312, 313, 314, and 315 shown, for purposes of illustration, as similarly sized and positioned to those of the swirler/nozzle of FIG. 2. The swirler 302 may have an axis 510' similarly positioned and oriented to the axis 510. However, the nozzle 304 is eccentrically mounted in the swirler so that a nozzle axis 510" is not coincident with the axis 510'. In the illustrated example, the axis 510" is parallel to and slightly offset in the radial direction 502 from the axis 510'. This offset biases the fuel spray distribution radially outward.

One or more embodiments of the present invention have been described. Nevertheless, it will be understood that various modifications may be made without departing from the spirit and scope of the invention. For example, in a reengineering or remanufacturing situation, details of the baseline configuration may influence details of any particular implementation. Accordingly, other embodiments are within the scope of the following claims.

What is claimed is:

1. A gas turbine engine swirler/nozzle apparatus within a combustor, the apparatus comprising:

a swirler having a central axis; and a nozzle having an outlet end with a plurality of fuel outlets, the nozzle having an asymmetry about said central axis, the asymmetry comprising a first of said fuel outlets being smaller than a remainder of said fuel outlets, wherein said remainder of said fuel outlets are substantially the same size.

2. The apparatus of claim 1 further comprising:

a leg extending transversely to the central axis, wherein the asymmetry is effective to provide a lesser fuel flow opposite said leg than adjacent said leg.

3. The apparatus of claim 1 wherein:

there are 4-12 of said fuel outlets at a single radius from said central axis.

4. A gas turbine engine comprising:

a compressor section;

said combustor being an annular combustor receiving air from the compressor section; and a turbine section receiving combustion gases from the combustor and driving the compressor section, wherein, the combustor comprises:

a circumferential array of gas turbine engine swirler/nozzle apparatus of claim 1.

5. The engine of claim 4 wherein:

there are 12-30 of said gas turbine engine swirler/nozzle apparatus.

6. The engine of claim 4 wherein:

the asymmetry of each gas turbine engine swirler/nozzle apparatus is effective to provide a lesser fuel flow from a first half of the nozzle of said gas turbine engine swirler/nozzle apparatus than from a complementary second half, the first half relatively inboard of the second half.

7. The gas turbine engine swirler/nozzle apparatus of claim 1 wherein:

the asymmetry is effective to provide a centroid of a discharge fuel flow off-center from the central axis.

8. A method for operating a gas turbine engine, the engine comprising a compressor section, an annular combustor receiving air from the compressor section and having a circumferential array of swirler/nozzle apparatus, and a turbine section receiving combustion gases from the combustor and driving the compressor section, wherein:

the swirler/nozzle apparatus each comprise:

a swirler having a central axis; and a nozzle having an outlet end with a plurality of fuel outlets, the nozzle having an asymmetry about said central axis, the asymmetry comprising a first of said fuel outlets being smaller than a remainder of said fuel outlets, wherein said remainder of said fuel outlets are substantially the same size, the method comprising:

discharging fuel from said apparatus with more fuel being discharged from outboard halves of the apparatus than from complementary inboard halves.

9. The method of claim 8 wherein:

a fuel flow rate through the outboard halves is at least 110% of a fuel flow rate through the inboard halves.

* * * * *